US007600578B2

(12) United States Patent
Crooks

(10) Patent No.: US 7,600,578 B2
(45) Date of Patent: Oct. 13, 2009

(54) PERCUSSION ADAPTER FOR POSITIVE DISPLACEMENT MOTORS

(76) Inventor: Dale G. Crooks, Box 64004, 5512 - 4th Street NW., Calgary, AB (CA) T2K 6J1

( * ) Notice: Subject to any disclaimer, the term of this patent is extended or adjusted under 35 U.S.C. 154(b) by 13 days.

(21) Appl. No.: 11/854,725

(22) Filed: Sep. 13, 2007

(65) Prior Publication Data

US 2008/0217038 A1 Sep. 11, 2008

Related U.S. Application Data

(60) Provisional application No. 60/893,289, filed on Mar. 6, 2007.

(51) Int. Cl.
*E21B 6/00* (2006.01)
*E21B 6/02* (2006.01)

(52) U.S. Cl. ..... 173/107; 173/13; 173/17

(58) Field of Classification Search ..... 173/1, 173/15, 17, 79, 136, 206; 175/107, 317
See application file for complete search history.

(56) References Cited

U.S. PATENT DOCUMENTS 3,453,657 A * 7/1969 Hayes et al. ..... 173/17
4,133,393 A * 1/1979 Richards ..... 173/64
6,508,317 B2 * 1/2003 Eddison et al. ..... 175/107
6,742,605 B2 6/2004 Martini

FOREIGN PATENT DOCUMENTS

EP 1 038 086 4/2004

* cited by examiner

*Primary Examiner*—Rinaldi I. Rada
*Assistant Examiner*—Nathaniel Chukwurah
(74) *Attorney, Agent, or Firm*—Bennett Jones LLP

(57) ABSTRACT

A percussion adapter for a positive displacement motor including a housing, a torque tube and a reciprocating percussive piston operable by application of fluid pressure thereto. The piston can be driven to create a percussive effect by rotary movement of the torque tube. The percussion adapter can have a bypass option to allow flow through the percussion adapter without operation of the piston.

7 Claims, 7 Drawing Sheets

| |
|---|
| FIG. 1a |
| FIG. 1b |
| FIG. 1c |

PERCUSSION ADAPTER FOR POSITIVE DISPLACEMENT MOTORS

FIELD OF THE INVENTION

The present invention relates to a well drilling tool and in particular a drilling tool for use with positive displacement motors.

BACKGROUND

Positive displacement motors (PDMs) are widely used in the oil and gas industry as an adjunct for drilling a hole in earthen formations. The PDM uses pressure and flow of the drilling fluid to turn a rotor within a stator. The rotor then turns a drill bit which removes earthen cuttings, creating the hole. The drilling fluid then captures the earthen cuttings and removes them from the hole. When drilling with a PDM, the drill string does not have to be rotated to drill (as is the case with conventional drilling) and this allows the drill string to be oriented, resulting in directional drilling.

If one could add a percussive force to the drill bit on the PDM, it is believed that the rate of drilling penetration could be significantly increased, the required weight on bit could be significantly reduced and torque required to turn the drill bit could be significantly reduced. All in all, a "percussionized" PDM should be an efficient drilling tool.

SUMMARY

In accordance with a broad aspect of the present invention, there is provided a method for creating a percussive effect on a rotary driven drill bit, the method comprising: providing a positive displacement motor including a motor housing, a fluid discharge and a rotor powered by fluid pressure; providing a drill bit; providing a percussion adapter including a housing, a torque tube, the torque tube having an upper end and a lower end and being rotationally moveable about its long axis within the housing, a fluid pressure driven piston within the housing configured to be driveable through application of fluid to a drive hydraulic chamber to strike the torque tube and drivable through a charging stroke by application of fluid to a charging hydraulic chamber; and a fluid passage through the torque tube communicable to the piston; connecting the percussion adapter to the motor including connecting the housing to move with the motor housing, connecting the torque tube to be driven rotationally by the rotor and bringing the fluid passage into communication with the fluid discharge; connecting the drill bit to the lower end of the torque tube; supplying fluid through to motor to drive the rotor and the torque tube to rotate; discharging fluid from the fluid discharge to pass into the fluid passage; and communicating the fluid alternately (i) to the drive hydraulic chamber to cause the piston to strike the torque tube and (ii) to the charging chamber to move the piston through a charging stroke, the alternate communication of the fluid to the drive hydraulic chamber and the charging chamber being controlled by rotation of the torque tube.

In accordance with another broad aspect of the present invention, there is provided a percussion adapter for use with a positive displacement motor and a drill bit, the percussion adapter comprising: a housing; a torque tube, the torque tube having an upper end for engagement to a rotor of a positive displacement motor and a lower end for engagement of a drill bit and being rotationally moveable about its long axis within the housing; a fluid pressure driven piston within the housing configured to be driveable through a cycle including a drive stroke and a charging stroke, the piston drivable through application of fluid to a drive hydraulic chamber to strike the torque tube and drivable through the charging stroke by application of fluid to a charging hydraulic chamber; a fluid passage through the torque tube communicable to the piston; a first port from the fluid passage openable to the drive hydraulic chamber, when the torque tube is in a first rotational orientation; and a second port from the fluid passage openable to the charging hydraulic chamber, when the torque tube is in a second rotational orientation, the first port being closed when the torque tube is in the second rotational orientation.

In accordance with another broad aspect of the present invention there is provided a method for operating a percussion adapter for a rotary driven drill bit, the method comprising: providing a positive displacement motor including a motor housing, a fluid discharge and a rotor powered by fluid pressure; providing a drill bit; providing a percussion adapter including a housing, a torque tube, the torque tube having an upper end and a lower end and being rotationally moveable about its long axis and longitudinally moveable within the housing, a fluid pressure driven piston within the housing configured to be driveable through application of fluid to generate a percussive effect to the torque tube; and a fluid passage through the adapter openable to communicate with the piston; connecting the percussion adapter to the motor including connecting the housing to move with the motor housing, connecting the torque tube to be driven rotationally by the rotor and bringing the fluid passage into communication with the fluid discharge; connecting the drill bit to the lower end of the torque tube; supplying fluid through the motor to drive the rotor and the torque tube to rotate; discharging fluid from the fluid discharge to pass into the fluid passage; and alternately (i) communicating the fluid to the piston to drive the piston and (ii) allowing bypass of fluid through the percussion adapter to the drill bit without driving the piston.

In accordance with another broad aspect of the present invention there is provided a percussion adapter for use with a positive displacement motor and a drill bit, the percussion adapter comprising: a housing; a torque tube, the torque tube having an upper end for engagement to a rotor of a positive displacement motor and a lower end for engagement of a drill bit and being rotationally moveable about its long axis and longitudinally moveable within the housing; a fluid pressure driven piston within the housing configured to be driveable by fluid pressure to generate a percussive effect in the adapter; a fluid passage through the adapter including an inlet passage through the torque tube communicable to the piston to drive the piston to generate a percussive effect; and a bypass passage through the adapter to permit passage of fluid through the adapter without driving the piston, a porting arrangement controlling access to the inlet passage and the bypass passage depending on the longitudinal position of the torque tube within the housing.

In accordance with another broad aspect of the present invention there is provided a percussion adapter for use with a positive displacement motor and a drill bit, the percussion adapter comprising: a housing; a torque tube, the torque tube having an upper end for engagement to a rotor of a positive displacement motor and a lower end for connection of a drill bit and being rotationally moveable about its long axis within the housing; a fluid pressure driven piston within the housing configured to be driveable by application of fluid to a drive hydraulic chamber to generate a percussive effect against the torque tube; a fluid inlet passage communicable to the drive hydraulic chamber; a discharge passage openable from the drive hydraulic chamber; and a valving arrangement to open and close access from the fluid inlet passage and the discharge passage to the drive hydraulic chamber, the valving arrangement including a bypass operation to open access to both the fluid inlet passage and the discharge passage at the same time to permit bypass of fluids through the drive hydraulic chamber.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

Referring to the drawings wherein like reference numerals indicate similar parts throughout the several views, several aspects of the present invention are illustrated by way of example, and not by way of limitation, in detail in the figures, wherein:

FIG. 1 shows the configuration of FIGS. 1*a* to 1*c*.

DESCRIPTION OF VARIOUS EMBODIMENTS

Figures 1, 1A:
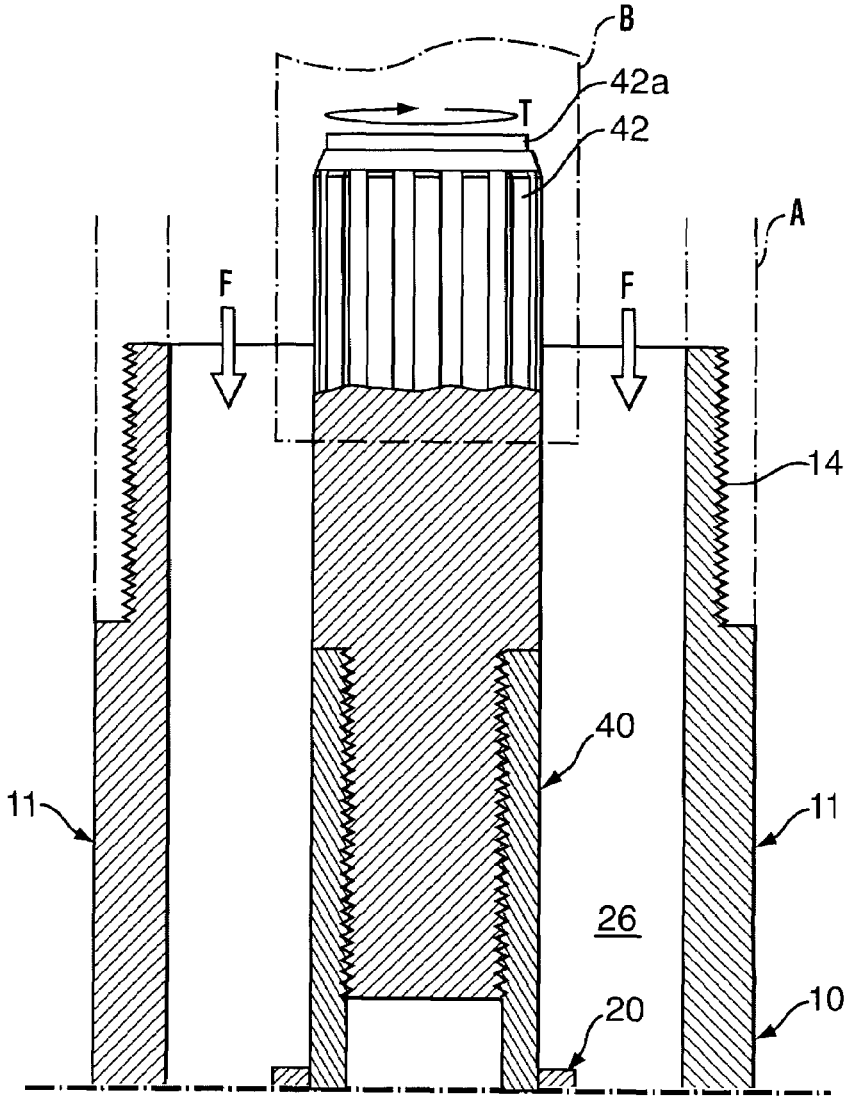
FIGS. 1 to 1*c* are together an axial sectional view of a percussion adapter showing the percussion piston in a position ready for being driven through a percussive stroke.
Figure 1B:
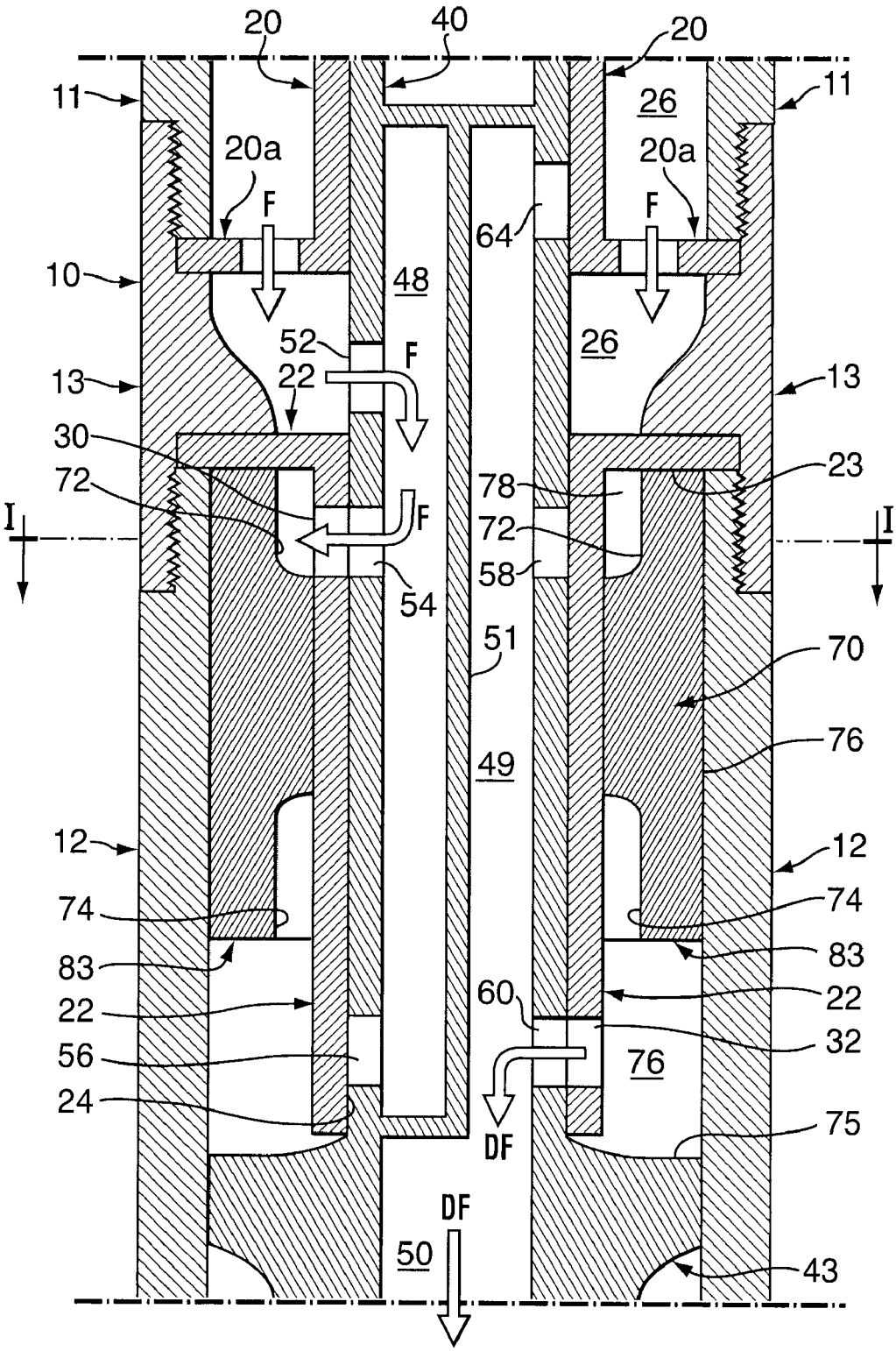
Figure 1C:
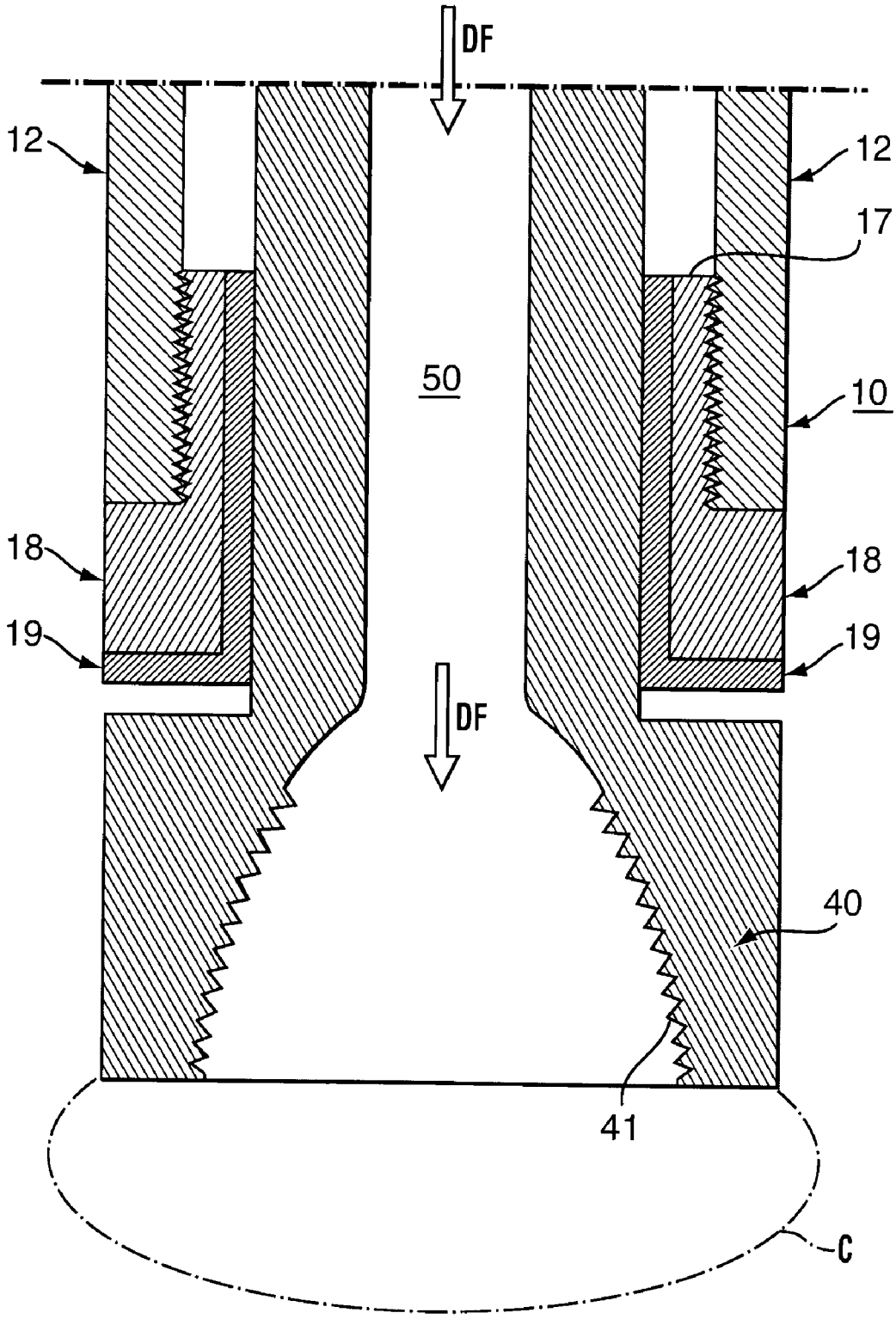

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

It has been well documented that providing a percussion force to a rotating drill bit will make the drill bit drill faster. The percussive force helps to break away portions of the drilled formation.

When drilling in hard earthen formations with a PDM, one must place a great deal of weight on the drill bit in order to break away pieces of formation and create a drilled hole. The placement of excessive weight on the drill bit has been known to cause one or more of the following problems:

1. Potential to stall the PDM rotor, with a stoppage of drilling.
2. Potential to deviate from the expected wellbore, as the PDM follows formation planes.
3. Potential to create more torque in the drill string, making it difficult to orient the drill bit.
4. Potential to shorten the useful life of the PDM itself, due to greater pressures within the PDM components.

By adding a percussive force to the drill bit, the PDM could operate with significantly less weight on the drill bit, thus alleviating the above problems.

The rate of penetration (ROP) of a drilling device has a direct bearing on the economics of a drilling operation. A modem drilling rig with all its associated services can be a hugely expensive operation. It is very obvious that if a PDM operating in a percussion mode, could drill significantly faster than a conventional PDM, the economic savings could also be significant.

One embodiment of a percussion adapter for use with a PDM is illustrated with reference to the Figures. The percussion adapter may be installed on a drill string to drill a borehole through an earthen formation. The percussion adapter may be installed between a PDM and a drill bit to convey rotational energy from the PDM to the drill bit and to generate and apply a percussive force to the drill bit. Percussive force is generated by the percussion adapter by use of fluid pressure discharged from the PDM.

The tool generally comprises a housing 10, a torque tube 40 and a percussion-generating sliding piston 70.

Housing 10 may be formed in various ways to house and permit operation of the components of the tool. In the illustrated embodiment, an upper casing 11, a lower casing 12 and a casing connector 13 together form housing 10 of the tool. Casings 11, 12 and 13 may be connected in various ways such as for example using threaded connections, as per typical oil tool construction.

Upper casing 11 includes a threaded interval 14 or other connection for use in securing housing 10 onto a lower portion of a PDM (schematically indicated as A). A PDM may already have a corresponding threaded interval or other corresponding connection or may have to be modified to accept connection of the upper casing. Housing 10 moves with the housing of the PDM to which it is attached. It will be appreciated that the PDM housing moves with the drill string, while the PDM rotor (schematically indicated as B) is rotated within the PDM housing.

Torque tube 40 operates within the tool housing 10 to transmit torque from the PDM rotor to a drill bit (indicated as C). Torque tube may be formed in various ways, such as by connection of a plurality of parts, by boring, milling, or various combinations thereof. Torque tube 40 includes a threaded interval 41 or other connection at its lower end for use in securing a drill bit. As will be appreciated, drill bits are often formed with threaded connections for general use and threaded interval 41 may be formed with consideration as to the drill bit to be connected thereto.

Torque tube 40 is connectable to the PDM rotor (not shown) via a sliding spline 42 on its upper end. Sliding spline 42 is formed to engage a splined output coupling on a PDM rotor, such that rotational drive and torque T may be communicated from the rotor to the torque tube. The splined arrangement allows longitudinal, sliding motion of the torque tube relative to the PDM, while maintaining a torque transmitting connection therebetween. Torque tube 40 moves longitudinally within housing 10 during operation of the tool. The longitudinal motion of the torque tube may be limited in various ways to maintain its proper operational configurations, such as to maintain the connection between the torque tube and the PDM rotor. For example, in one embodiment, longitudinal movement of torque tube 40 is limited by shoulders fixed to the housing. In the illustrated embodiment, a drive sub 18 is fixed within the housing and creates a shoulder 17 that acts against a shoulder 43 on torque tube 40 to limit downward movement of the torque tube within the housing. Drive sub 18 may be installed in the housing in various ways, as by threaded engagement to one of the housing components, such the lower casing 12. Generally, it is desirable to transfer weight and forces through the torque tube into the PDM rotor to be taken up by the thrust bearings of the motor. Thus, axial load and force transfer may occur through the spline 42 and the splined output coupling of the PDM. To provide some shock absorption at that connection, a shock absorbing member, such as an elastomeric pad 42*a*, may be installed to act between axially contacting parts of the torque tube and the PDM rotor.

As noted previously, housing 10 moves with the PDM housing, while torque tube 40 is rotated by the PDM rotor. As such, torque tube 40 rotates within housing 10. Housing 10 may therefore include one or more bearings to support the rotation of the torque tube. In the illustrated embodiment, drive sub 18 includes a bearing surface 19 for the rotational motion of torque tube 40. In the illustrated embodiment, the torque tube is further stabilized by an upper bearing 20. Upper bearing 20 may be positioned within housing in various ways. For example, as illustrated, upper bearing 20 may be held in place by a radial flange 20*a* installed at the threaded junction between upper casing 11 and casing connector 13. Further bearings may be used as desired. During normal drilling operations, it may be useful to isolate the axial loads of the torque tube from the housing. Thus, it may be useful to form the torque tube and the housing to avoid direct shouldering thereon during drilling operations, as shown between bearing 19 and torque tube 40 adjacent end 41.

Figure 3:
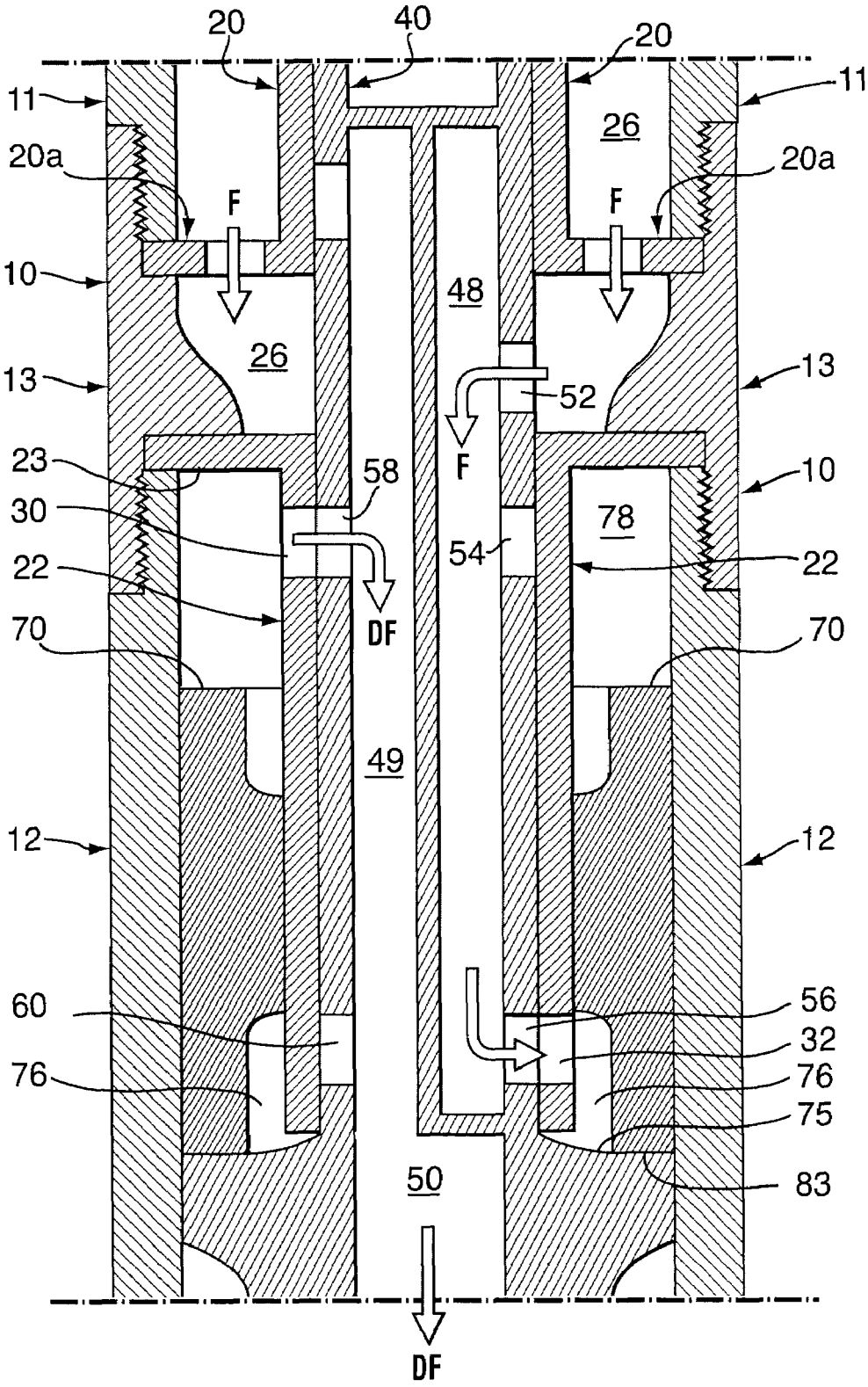
FIG. 3 is an axial sectional view of the percussion adapter of FIG. 1 with the piston in a striking position creating a hammering effect.

As noted, the tool further includes a sliding piston 70, which is able to impart blows to torque tube 40. The energy of the blows is then transferred to any drill bit connected at threaded interval 41 of the torque tube. Piston 70 slides longitudinally along the tool and includes an upper piston face 72 and a lower piston face 74. Fluid pressure may act against faces 72, 74 to drive the piston through a cycle including a charging stroke, where piston 70 is moved away from its striking position against a contact portion such as shoulder 75 on the torque tube, and a percussive stroke, where piston is driven toward its striking position. The percussive stroke ends with the piston striking against shoulder 75 on the torque tube, termed herein the striking position. FIG. 1 shows the piston at the end of the charging stroke, ready to be driven through the percussive stroke, while FIG. 3 shows the piston in the striking position at the end of the percussive stroke. The longitudinal sliding motion of piston 70 may be limited in the upward direction by a shoulder on the housing.

Although various piston forms may be useful, in one embodiment piston 70 may be formed as an annular member and may slide in an annulus between housing 10 and torque tube 40. In the illustrated embodiment, the outer surface 76 of the piston slides with a close fit within the confines of the housing, while the inner diameter of the piston slides along a piston liner 22. In this embodiment, piston liner 22 defines a bearing surface for the piston inner diameter, defines a hydraulic chamber about the piston and defines a stop shoulder 23 against which the piston stops at the end of the charging stroke. Piston liner 22 is fixed within and moves with the housing. Thus, the piston liner remains stationary while torque tube 40 rotates therewithin. The piston liner may be formed and fixed in various ways to the housing. In the illustrated embodiment, the piston liner is held in place by installation at the threaded junction of the lower casing 12 and the casing connector 13. In the illustrated embodiment, piston liner 22 also forms another bearing surface 24 for the torque tube.

As noted previously, the piston is driven by fluid discharged from the PDM. Fluid passages are provided to allow the flow of drilling fluids under pressure, arrows F, through various paths through the tool. The specific arrangement of passages allow for the required flows of drilling fluid to activate the piston into a reciprocating motion, providing the impact blows to the torque tube 40.

In the illustrated embodiment, fluid enters the tool from the PDM through a main passage 26 that passes down through tool toward piston 70. Main passage 26 may be defined through bores in the housing, through an annular opening between housing 10 and torque tube and/or through bores through tube, as desired. In the illustrated embodiment, for example, main passage 26 extends through an annular area and flange 20*a* includes ports therethrough to permit passage of fluid.

From main passage 26, fluid passages are openable through various paths to operate the piston and, in one embodiment, to pass through the tool and bypass the piston entirely. Torque tube 40 may operate to control the path taken by the fluid depending on its axial and/or rotational orientation within the housing. In one embodiment, torque tube 40 includes an inlet passage 48 that directs fluid through various paths to drive the piston through its cycle, the path being dependent on the rotational orientation of the torque tube within the housing. In particular, in the illustrated embodiment, the torque tube includes passage 48 that, when the torque tube is in a first rotational orientation relative to the housing (FIG. 1), opens communication between the passage 26 and drive chamber 78 with piston face 72 therein and, when the torque tube is in a second rotational orientation (FIG. 3), opens communication between the passage 26 and a charging chamber 76 having therein piston face 74.

In another embodiment, torque tube 40 includes a discharge passage that allows fluid discharge, arrows DF, from charging chamber 76 or drive chamber 78, depending on the rotational orientation of the torque tube within the housing. In particular, in the illustrated embodiment, the torque tube includes a discharge passage 49 that, when the torque tube is in the first rotational orientation relative to the housing (FIG. 1), opens communication between the charging chamber 76 and a main discharge passage 50 that opens at threaded interval 41 to provide fluid to any drill bit connected thereto. As shown in FIG. 3, when the torque tube is in the second rotational orientation, discharge passage 49 opens communication between drive chamber 78 and main discharge passage 50.

In the illustrated embodiment, torque tube includes inlet passage 48 and discharge passage 49 that are isolated from each other and extend parallel as by installing a wall 51 along a length of the tubular inner bore. The fluid path control may, in particular, be provided by a plurality of ports that are arranged to open and close access from the passages of the torque tube to the hydraulic chambers about the piston during rotation of the torque tube. For example, a port 52 through the wall of tube 40 provides access from main passage 26 to passage 48. Passage 26 may be formed annularly about the torque tube such that regardless of the rotational orientation thereof, port 52 remains open to passage 26. Also in the illustrated embodiment, upper and lower ports, 54, 56 respectively, through tube 40 provide outlet from passage 48 to the drive and charging chambers, respectively.

Also as shown in this embodiment, upper and lower ports 58, 60 through the wall of tube 40 provide access from the drive and the charging chambers, respectively, to passage 49. To further control fluid flow to the piston chambers 76, 78, ports may be formed through piston liner 22. For example, although ports 54 and 56 are always open to fluid flow thereto (from passage 26 through port 52 to passage 48), further ports may be formed through the piston liner such that he liner either opens or blocks access to the piston chambers, depending on the rotational orientation of the torque tube and whether or not the torque tube ports are aligned with the ports of the liner. This creates a valving arrangement that controls fluid flow to the piston chambers. In the illustrated embodiment, for example, one or more ports 30 are formed through the liner at a position opening to drive chamber 78 and one or more ports 32 are formed through the liner at a position opening to charging chamber 76. Ports 30 and 32 may be positioned and formed with consideration as to the size and positioning of ports 54, 56 such that in any rotational position, port 54 is substantially only aligned with port 30 or port 56 is substantially only aligned with port 32. In this way, fluid inlet through passage 48 may only be communicated to either piston chamber 78 or 76 at any one time. To avoid a pressure lock condition, ports 30, 32, 54 and 56 may be positioned with consideration as to the positioning of ports 58, 60 such that when fluid is being communicated from passage 26 to one of the charging or drive hydraulic chambers, the discharge ports 58 and 60 are substantially aligned with the piston liner ports of the other hydraulic chamber. For example, the ports of the torque tube and the liner should be formed such that when ports 30 and 54 are substantially aligned to communicate fluid to chamber 78, ports 32 and 60 are also substantially aligned so that fluid may be discharged from chamber 76. As will be appreciated, to avoid a pressure balanced condition across piston 70, fluid pressure may be communicated fully to substantially only one of the hydraulic chambers at one time and the ports must be positioned accordingly.

If desired, one or more of any or all of the particular ports may be provided. Of course, reduction in the numbers of ports may facilitate design and construction and due to the size of the components, it may be reasonable to reduce the numbers of ports and such that their sizes may be maximized, etc. However, the numbers of ports may control the rate of reciprocation of the piston, by for example, the numbers of times that pressurized fluid is applied against the piston faces during rotation of the torque tube. In one embodiment, for example, identical pluralities of piston liner ports are provided for both the drive chamber and the charging chamber. In the illustrated embodiment, there are five ports 30, five ports 32 and one of each other port 54, 56, 58 and 60. Using such a port ratio with a motor running at 60 rpm, the piston will strike the torque tube 5 times per second, for a cycle time of 0.2 seconds. The port sizes and hydraulic chambers may be sized to provide sufficient piston displacement during this cycle time. For example, for a motor operating at 60 rpm, a flow rate of 2000 liters/minute provides a more than sufficient volume to displace the piston through its stroke distance within the allotted cycle time for a percussion adapter with an 11" OD casing and a piston stroke of 1½".

To facilitate construction, the ports 54, 56 may be axially aligned along the torque tube so that their rotational orientation at any moment in time corresponds and, likewise, ports 58, 60 may be axially aligned along the torque tube. Also to facilitate construction, the inlet and discharge ports for any chamber, for example ports 54 and 58, may be diametrically opposed across the torque tube and substantially equal in cross sectional flow area. Also, the piston liner ports 30 and 32 may each be substantially similar in cross sectional flow area and substantially evenly spaced about the piston liner circumference at their relative locations. Also, each of the ports 30 may be axially offset from each of the ports 32, but maximized in size with respect to the size of torque tube ports 54, 56, 58 and 60 such that as one port opens, the next closes.

Figure 2:
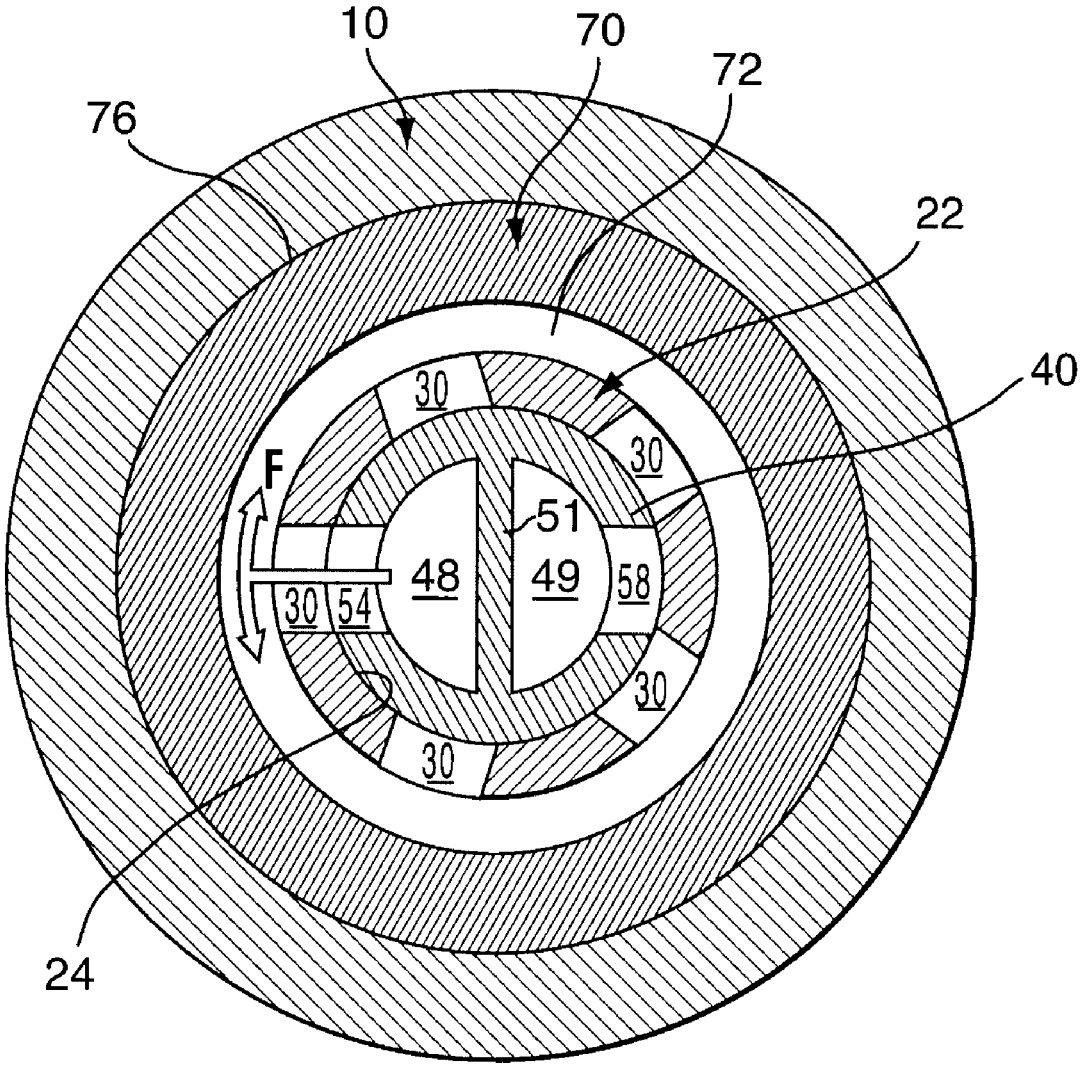
FIG. 2 is a section along line I-I of FIG. 1.
Figure 4:
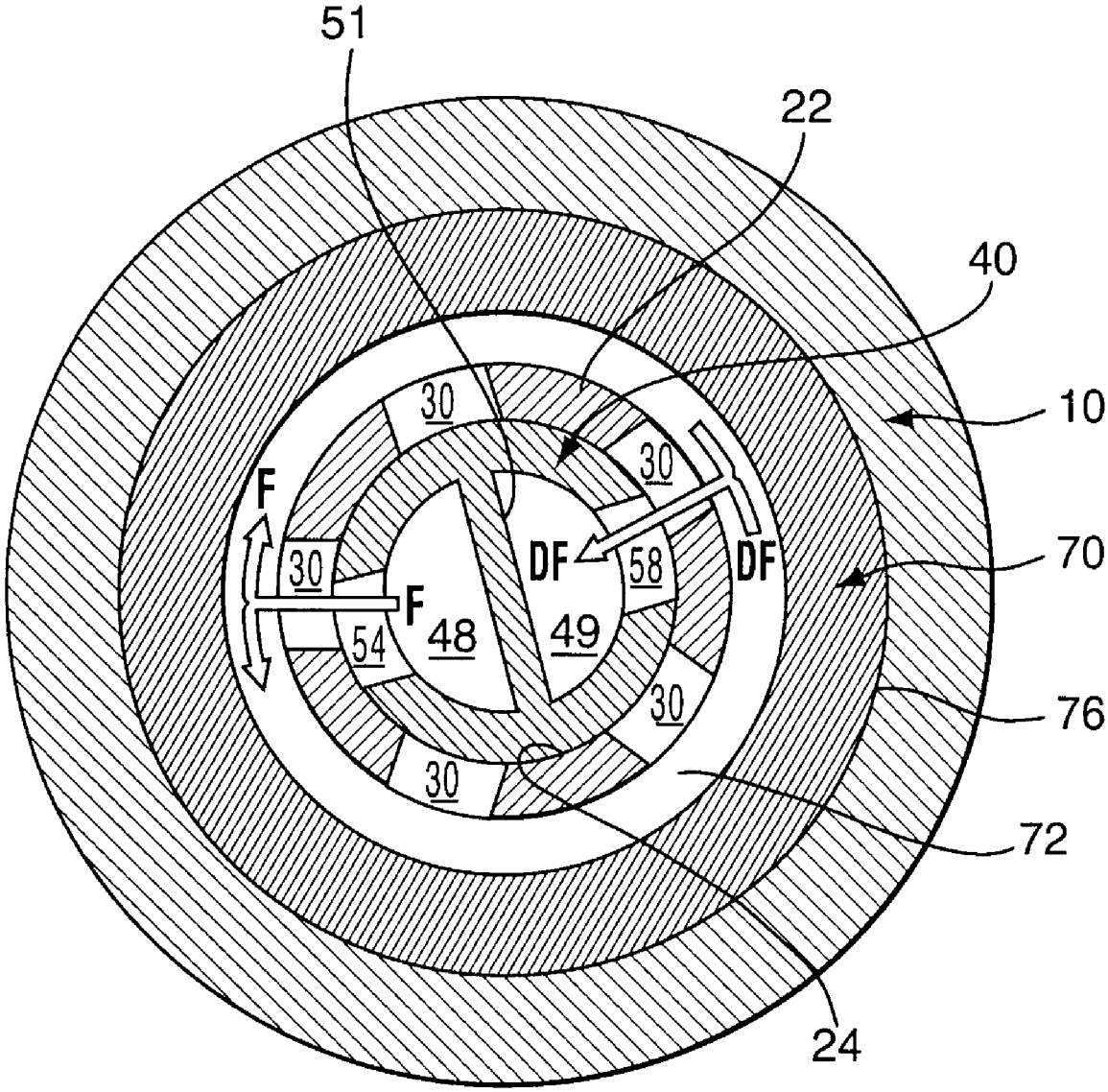
FIG. 4 is a sectional view taken along the same line as FIG. 2, but with the torque tube rotated to a different position.

In one embodiment, best understood by reference to FIGS. 2 and 4, the torque tube inlet and discharge ports and the piston liner ports for each chamber are correspondingly positioned and sized such that there is a period in each cycle when both the discharge and the inlet ports are opened to a hydraulic chamber. For example, this may be accomplished by providing at least two ports 30 that are positioned and sized with respect to ports 54, 58, such that when port 54 is moving out of alignment with one of the ports 30, port 58 is moving into alignment with another of the ports 30. As such, an amount of fluid may bypass through the hydraulic chamber without acting on the piston. This allows an excess of drilling fluid to be passed through the adapter during operation to ensure a continuous flow through the drill bit. Piston faces 72, 74 may be formed to ensure that open communication is provided between at least two of the piston liner ports of the same hydraulic chamber. For example, piston faces 72, 74 in the illustrated embodiment are contoured to remain open to all ports even when the piston is in its maximum stroke position stopped against walls 23 or 75.

Whenever drilling fluid is circulating through the percussion adaptor, torque tube 40 will be necessarily rotating because of the action of the PDM. When the PDM and percussion adaptor are "on bottom" with weight applied, torque tube 40 is positioned in the housing as shown in FIGS. 1 to 4. In this mode, the drilling fluid is now routed into the torque tube 40 through passage 26, port 52, and passage 48 and through either port 54 or 56, which ever is aligned with its piston liner port, into first one and then the other of the piston's hydraulic chambers 78 or 76 to drive the piston. As torque tube 40 rotates, the drilling fluid is forced alternately into charging chamber 76 and drive chamber to cycle the piston. At the same time, the drilling fluid on the other side of piston 70 is vented into discharge passage 49 and is expelled through passage 50 and any drill bit connected at threaded connection 41.

Whenever, fluid is forced into the drive chamber, piston 70 is forced down to strike the torque tube 40, for example at shoulder 75, to create a percussive effect on the torque tube and therethrough to the drill bit attached thereto.

The percussive effect of the piston is provided by impact of the piston against the torque tube. In some instances, a dampening effect may occur wherein the evacuating fluid acts to prevent firm contact between the piston and torque tube during the percussive strike. If this is found to occur, the piston surface that contacts the torque tube or the shoulder that accepts contact from the piston can be formed with drainage grooves to permit evacuation of fluid therethrough while the parts otherwise come together with firm metal to metal contact. For example, in the illustrated embodiment, contact surface 83 includes drainage grooves thereon that open to chamber 76. For example, the drainage grooves may be radially extending grooves formed on contact surface. Raised portions between the drainage grooves provide the surface that strikes against shoulder 75.

The above-noted operation of the percussion adapter is dependent on the axial alignment of port 52 with passage 26, ports 54, 58 with ports 30 and ports 56, 60 with ports 32. Thus, the longitudinal position of the torque tube 40 relative to the housing, for example, relative to the inlet fluid passage from the PDM and the hydraulic chambers is necessary for providing the percussion action of piston 70.

Figure 5:
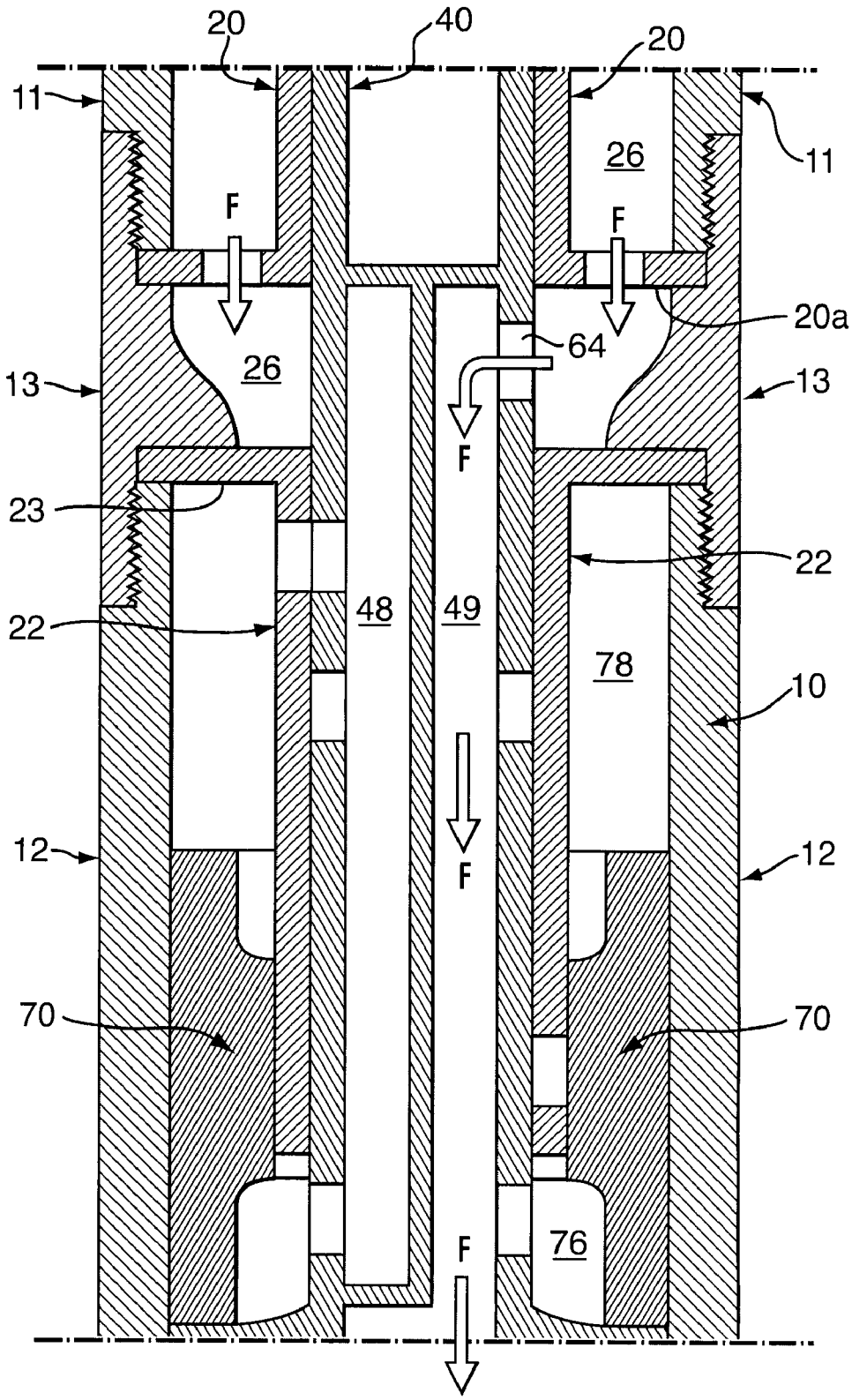
FIG. 5 is an axial sectional view of the percussion adapter of FIG. 1 in a circulation mode.

In one embodiment, when there is no weight on the PDM and percussion adaptor, torque tube 40 may move axially down relative to housing 10, for example by gravity, as limited by abutment of torque tube shoulder 43 against the shoulder 17 fixed in housing 10. As shown in the embodiment illustrated in FIG. 5, the percussion adapter may move into a circulation mode when torque tube 40 slides down relative to housing 10. In particular, torque tube 40 may include a bypass port 64 that is open to discharge passage 49 and positioned to be in communication with passage 26 when the torque tube drops down in the housing (i.e. when the drill bit is pulled off bottom). In the illustrated configuration, port 64 is axially spaced above port 52 and positioned with consideration as to the location of shoulder 43 to become aligned with passage 26 when the torque tube is resting on shoulder 17. In this mode, the drilling fluid passes through passage 26 and into torque tube 40 and then passes straight through the torque tube discharge passages 49 and 50 out through the drill bit. There is no piston motion in this mode. In particular, although discharge passage 49 includes ports 58, 60 therefrom, fluid either is communicated in a balanced fashion across the piston, as shown, or cannot be communicated to both chambers 76, 78 because of the axial misalignment between the various ports, such responses caused by the lower position of the torque tube. Typically this mode is used for flushing cuttings out the wellbore with the circulation of the drilling fluid. When the PDM and percussion adaptor are lifted off bottom, the torque tube 40 drops longitudinally and the circulation mode, as shown in FIG. 5, is set up. When the PDM and percussion adapter are on bottom, access to port 64 is blocked by bearing 20 so that all fluid through passage is directed through passage 48 to drive the piston.

Components of the percussion adapter may at least in part be operationally required to substantially hold fluid pressure and to accommodate rigors of down hole drilling operations including the percussive forces generated thereby. As such the percussive adapter and the components thereof should be constructed with consideration of those conditions. In one embodiment, for example, portions of the tool including portions of the torque tube about its ports and portions of the piston liner about its ports may be formed of materials exhibiting good resistance to wear and erosion such as tungsten carbide.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

I claim:

1. A percussion adapter for use with a positive displacement motor and a drill bit, the percussion adapter comprising:

a housing;

a torque tube, the torque tube having an upper end for engagement to a rotor of a positive displacement motor and a lower end for engagement of a drill bit and being rotationally moveable about its long axis within the housing, a fluid pressure driven piston within the housing configured to be driveable through a cycle including a drive stroke and a charging stroke, the piston drivable through application of fluid to a drive hydraulic chamber to strike the torque tube and drivable through the charging stroke by application of fluid to a charging hydraulic chamber;

a fluid passage through the torque tube communicable to the piston;

a first port carried on the torque tube, the first port being from the fluid passage openable to the drive hydraulic chamber, when the torque tube is in a first rotational orientation;

a second port from the fluid passage openable to the charging hydraulic chamber when the torque tube is in a second rotational orientation, the first port being closed when the torque tube is in the second rotational orientation; and a liner between the drive hydraulic chamber and the torque tube, the liner including a plurality of valving ports therethrough alignable with the first port such that the first port passes over the plurality of ports during a rotation of the torque tube to repeatedly open and close access between the first passage and the drive hydraulic chamber.

2. The percussion adapter of claim 1 further comprising a fluid discharge passage through the torque tube; a first discharge port from the fluid discharge passage openable to the drive hydraulic chamber, when the torque tube is in the second rotational orientation; and a second port from the fluid discharge passage openable to the charging hydraulic chamber when the torque tube is in the first rotational orientation.

3. The percussion adapter of claim 1 further comprising a fluid bypass passage through the torque tube to conduct fluid through the percussion adapter without acting on the piston, the fluid bypass passage openable when the torque tube slides axially down relative to the housing.

4. A percussion adapter for use with a positive displacement motor and a drill bit, the percussion adapter comprising:

a housing;

a torque tube, the torque tube having an upper end for engagement to a rotor of a positive displacement motor and a lower end for connection of a drill bit and being rotationally moveable about its long axis within the housing;

a fluid pressure driven piston within the housing configured to be driveable by application of fluid to a drive hydraulic chamber to generate a percussive effect against the torque tube;

a fluid inlet passage communicable to the drive hydraulic chamber, the fluid inlet passage extending through the torque tube;

a discharge passage openable from the drive hydraulic chamber, the discharge passage extending through the torque tube; and a valving arrangement to open and close access from the fluid inlet passage and the discharge passage to the drive hydraulic chamber, the valving arrangement including a liner between the drive hydraulic chamber and the torque tube, the liner including a plurality of valving ports therethrough alignable with the fluid inlet passage and the discharge passage such that each passage passes over the plurality of ports during a rotation of the torque tube to repeatedly open and close access between the passages and the drive hydraulic chamber, the valving arrangement further including a bypass operation to open access to both the fluid inlet passage and the discharge passage at the same time to permit bypass of fluids through the drive hydraulic chamber.

5. The percussion adapter of claim 4 wherein the valving arrangement includes at least one valving port into the drive hydraulic chamber, the valving port positioned with consideration to the fluid inlet passage and the discharge passage and the valving arrangement moves the passages relative to the at least one valving port through at least three operational positions including (i) a position in which the fluid inlet passage is open through the at least one valving port to the drive hydraulic chamber and all communication between the discharge passage and the drive hydraulic chamber is blocked, (ii) a position in which the discharge passage is open through the at least one valving port to the drive hydraulic chamber and all communication between the fluid inlet passage and the drive hydraulic chamber is blocked, and (iii) a position in which both the fluid inlet passage and the discharge passage are open through the at least one valving port to the drive hydraulic chamber.

6. The percussion adapter of claim 4 wherein the plurality of valving ports includes at least a first port and a second port and the first and second ports are spaced relative to the position of the passages through the torque tube such that the torque tube can move through at least three operational positions including (i) a position in which the fluid inlet passage is open through the first port to the drive hydraulic chamber and all communication between the discharge passage and the drive hydraulic chamber is blocked by the liner, (ii) a position in which the discharge passage is open through the first port to the drive hydraulic chamber and all communication between the fluid inlet passage and the drive hydraulic chamber is blocked by the liner, and (iii) a position in which the fluid inlet passage is open through the first port to the drive hydraulic chamber and the discharge passage is open through the second port to the drive hydraulic chamber.

7. The percussive adapter of claim 4 further comprising a charging chamber acting opposite the drive hydraulic chamber, the charging chamber being communicable to the fluid inlet passage and openable to the discharge passage; a valving arrangement to open and close access from the fluid inlet passage and the discharge passage to the charging chamber.

* * * * *